United States Patent [19]

Stone

[11] Patent Number: 4,514,661

[45] Date of Patent: Apr. 30, 1985

[54] ARC-SUPPRESSION MEANS FOR AN ELECTRON GUN HAVING A SPLIT ELECTRODE

[75] Inventor: Robert P. Stone, Lancaster, Pa.

[73] Assignee: RCA Corporation, Princeton, N.J.

[21] Appl. No.: 424,136

[22] Filed: Sep. 27, 1982

[51] Int. Cl.[3] ..... H01J 29/96

[52] U.S. Cl. ..... 315/3; 313/414; 315/16

[58] Field of Search ..... 315/3, 16; 313/414

[56] References Cited

U.S. PATENT DOCUMENTS

| | | | |
|---|---|---|---|
| 2,829,292 | 4/1958 | De Vere Krause | 313/82 |
| 2,957,106 | 10/1960 | Moodey | 313/414 X |
| 3,295,008 | 12/1966 | Gallaro et al. | 315/3 |
| 3,355,617 | 11/1967 | Schwartz et al. | 313/82 |
| 3,758,802 | 9/1973 | Kubo et al. | 313/64 |
| 3,882,348 | 5/1975 | Paridaens | 313/450 |
| 3,909,655 | 9/1975 | Grimmett et al. | 313/450 |
| 3,932,786 | 1/1976 | Campbell | 315/3 |
| 3,950,667 | 4/1976 | DeJong et al. | 313/450 |
| 3,987,329 | 10/1976 | Yamazaki et al. | 313/414 X |
| 4,032,811 | 6/1977 | Schwartz et al. | 313/417 |
| 4,101,803 | 7/1978 | Retsky et al. | 315/3 |
| 4,143,298 | 3/1979 | Bing et al. | 315/3 |
| 4,220,893 | 9/1980 | Miller et al. | 313/450 |
| 4,243,911 | 1/1981 | Winarsky et al. | 315/3 |
| 4,255,689 | 3/1981 | Fischman et al. | 315/3 |
| 4,285,990 | 8/1981 | Hernqvist | 427/39 |
| 4,334,169 | 6/1982 | Takenaka et al. | 313/449 X |
| 4,345,185 | 8/1982 | Kobori | 315/3 |

FOREIGN PATENT DOCUMENTS 1273703 7/1968 Fed. Rep. of Germany .

OTHER PUBLICATIONS

J. W. Schwartz et al., "Recent Developments in Arc Suppression for Picture Tubes", Zenith Radio Corporation.

S. Takenaka et al., "New Hi-Fi Focus Electron Gun for Color Cathode-Ray Tube", Toshiba Review, pp. 30-35, No. 121, May-Jun. 1979.

Y. Kobori et al., "A Novel Arc-Suppression Technique for Cathode Ray Tubes", IEEE Chicago Spring Conference on CE, Jun. 19, 1980, Sony Corp.

*Primary Examiner*—Palmer Demeo

*Attorney, Agent, or Firm*—Eugene M. Whitacre; Dennis H. Irlbeck; Vincent J. Coughlin, Jr.

[57] ABSTRACT

An electron gun comprises at least one cathode for generating an electron beam along a beam path and a plurality of electrodes serially disposed along the beam path. The electrodes include at least one accelerating and focusing electrode having two spaced-apart electrode sections axially separated along a plane substantially perpendicular to the beam path. An arc-suppression resistor interconnects the spaced-apart electrode sections of the electrode. The interconnected electrode sections normally operate at substantially the same voltage. The arc-suppression resistor acts in the event of an arc to limit the arc current and prevent damaging cascading arcs.

4 Claims, 5 Drawing Figures

ARC-SUPPRESSION MEANS FOR AN ELECTRON GUN HAVING A SPLIT ELECTRODE

BACKGROUND OF THE INVENTION

The present invention relates to electron guns, and particularly to a cathode ray tube electron gun having a split electrode comprising two spaced-apart electrode sections interconnected by a current limiting arc-suppression resistor. The arc-suppression resistor, in the case of an electrical arc will limit the arc current and prevent damaging cascading arcs.

Cascading arcs are defined as a succession of rapidly initiating arcs between electrodes in high field regions of the electrode gun which permit a sufficiently high arc current to pass between electrodes of the electron gun and to subsequently damge the electron gun elements or the associated circuitry.

A conventional cathode-ray tube, for example, a color television picture tube, consists of an evacuated envelope having a neck portion, a faceplate and a funnel portion therebetween. An electron gun is disposed in the neck portion of the envelope, and a tricolor emitting phosphor screen is disposed on the interior surface of the faceplate. A shadow mask is located between the electron gun and the screen, in spaced relation to the screen. The electron gun comprises a plurality of electrodes for focusing and accelerating three electron beams toward the phosphor screen. Typically, several high voltage and low voltage electrodes are serially arranged along the electron beam paths to facilitate the focusing and accelerating of the electron beams. The high voltage electrodes typically operate at an ultor potential of about 30 kilovolts, and the low voltage electrodes typically operate at about 8 to 10 kilovolts or less; however, in some electron guns, an intermediate potential of about 12 kilovolts and a low potential of about 8 kilovolts or less are utilized. A conductive coating having an effective resistance of about 100 ohms is disposed on the interior surface of the funnel portion of the envelope. The interior conductive coating operates at ultor potential. Bulb spacers mounted on the electron gun electrode nearest the phosphor screen contact the interior conductive coating to provide ultor potential to the electron gun. An exterior conductive coating, electrically isolated from the interior conductive coating, is provided on the outside of the funnel to facilitate grounding of the envelope. The interior and exterior conductive coatings on the funnel also serve as a large capacitor which filters the high voltage.

The large voltage difference established between the high voltage and low voltage electrodes in the electron gun creates a possibility of arcing between the electrodes. The possibility of arcing is increased by irregular electrode surfaces, foreign matter in the interelectrode gaps and by misalignment or improper spacing between electrodes. When an arc occurs, the high voltage filter capacitor will, within a few microseconds or less, discharge its stored charge.

Because the instantaneous peak arc currents can approach hundreds or even thousands of amperes in magnitude, great destruction can be caused by such arcs, for example, the external receiver circuitry can be damaged by transient currents and voltages resulting from the arcs. Also, the gun electrodes can be burned or eroded to the point of inoperability, and electrode material may be sputtered onto adjacent surfaces resulting in the creation of leakage paths between tube elements.

In order to reduce tube arcing and to minimize the damage caused thereby, it is common to design cathode-ray tubes with maximum electrode spacings, to minimize field gradients, and to incorporate arc suppression systems into the tube.

Such an arc-suppression structure is disclosed in U.S. Pat. No. 4,345,185 issued to Y. Kobori on Aug. 17, 1982 and discussed by Y. Kobori et al. in their paper entitled, "A Novel Arc-Suppression Technique For Cathode Ray Tubes", presented at the IEEE Chicago Spring Conference on Consumer Electronics, June 19, 1980. The structure disclosed in the Kobori patent requires that a ceramic resistor be connected between the G3 and G5 high voltage electrodes (typically 30 kV) and that another resistor be connected between the low voltage G4 electrode and the stem lead attached thereto. When an arc occurs between adjacent electrodes, the arc current may flow either from the G5 through G3 to the G2 or to the G4. A problem occurs when the initial arc and the plasma generated thereby results in additional arcs, e.g., cascading arcs, between the other electrodes of the electron gun.

Therefore, an arc-suppression system must be able to protect the electron gun not only from the effects of individual arcs but from the effects of a cascading arcs. A number of arc-suppression systems that protect the electron gun from individual arcs and greatly reduces the probability of the occurrence of cascading arcs and the damage therefrom are described in a copending U.S. patent application Ser. No. 424,140 assigned to the same assignee as the present invention and filed on Sept. 27, 1982, by R. Stone and entitled, "Electron Gun Having Arc Suppression Means". The Stone patent application is incorporated by reference herein for the purpose of disclosure. The arc-suppression systems described in the copending Stone patent application require the use of at least two high voltage resistors and in some instances as many as four resistors are used. Since improvements in tube reliability must always be weighed against the cost of such improvements, it is apparent that a low cost arc-suppression system requiring only one resistor is desirable.

SUMMARY OF THE INVENTION

An electron gun comprises at least one cathode for generating an electron beam along a beam path and a plurality of electrodes serially disposed along the beam path. The electrodes include at least one accelerating and focusing electrode having two spaced-apart electrode sections axially separated along a plane substantially perpendicular to the beam path. An arc-suppression resistor interconnects the spaced apart electrode sections of the electrode. The interconnected electrode sections normally operate at substantially the same voltage. The arc-suppression resistor acts in the event of an arc to limit the arc current.

DETAILED DESCRIPTION OF THE PREFERRED EMBODIMENTS

Figure 1:
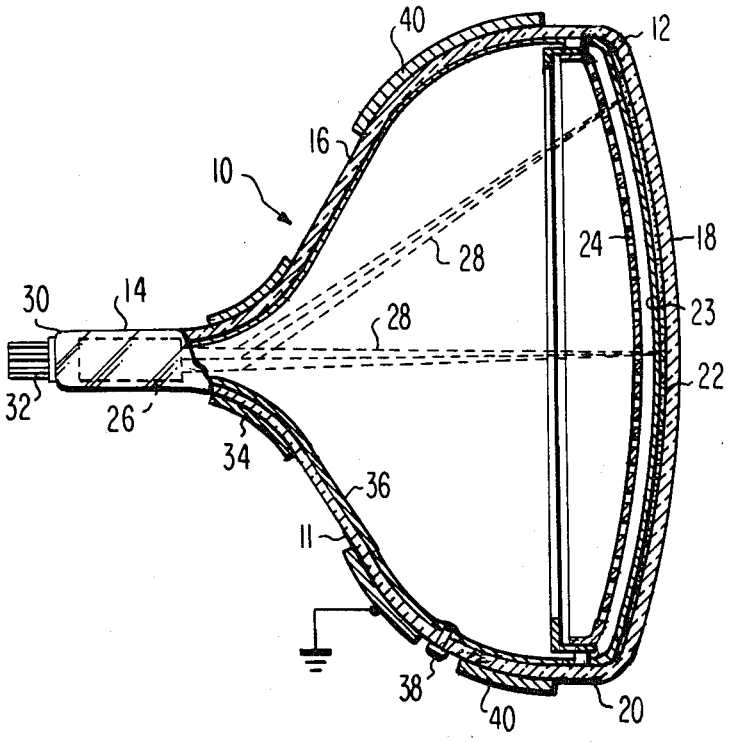
FIG. 1 is a plan view, partially in axial section, of a color cathode-ray tube (CRT) in which the present invention is incorporated.

FIG. 1 is a plan view of a rectangular color cathode-ray tube (CRT) or picture tube 10 having an evacuated glass envelope 11 comprising a rectangular faceplate panel 12 and a tubular neck 14 connected by a rectangular funnel 16. The panel comprises a viewing faceplate 18 and a peripheral flange or sidewall 20 which is sealed to the funnel 16. A mosaic three-color phosphor screen 22, which is backed by a reflective metal layer 23 of aluminum metal, is supported on the inner surface of the faceplate 18. The screen 22 may be either a line screen or a dot screen. A multiapertured color selection electrode or shadow mask 24 is removably mounted, by conventional means, in predetermined spaced relation to the screen 22. A novel in-line bipotential electron gun 26, shown schematically by dashed lines in FIG. 1, is centrally mounted within the neck 14 to generate and direct three electron beams 28 along spaced, co-planar convergent beam paths through the mask 24 to the screen 22. The end of the neck 14 is closed by a stem 30 having terminal pins or stem leads 32 on which the electron gun 26 is mounted and through which electrical connections are made to the various elements of the electron gun 26.

The tube of FIG. 1 is designed to be used with an external magnetic deflection yoke, such as the yoke 34 schematically shown surrounding the neck 14 and funnel 16 in the neighborhood of their junction. The yoke 34 subjects the three beams 28 to vertical and horizontal magnetic flux to scan the beams horizontally and vertically, respectively, in a rectangular raster over the screen 22.

Figure 2:
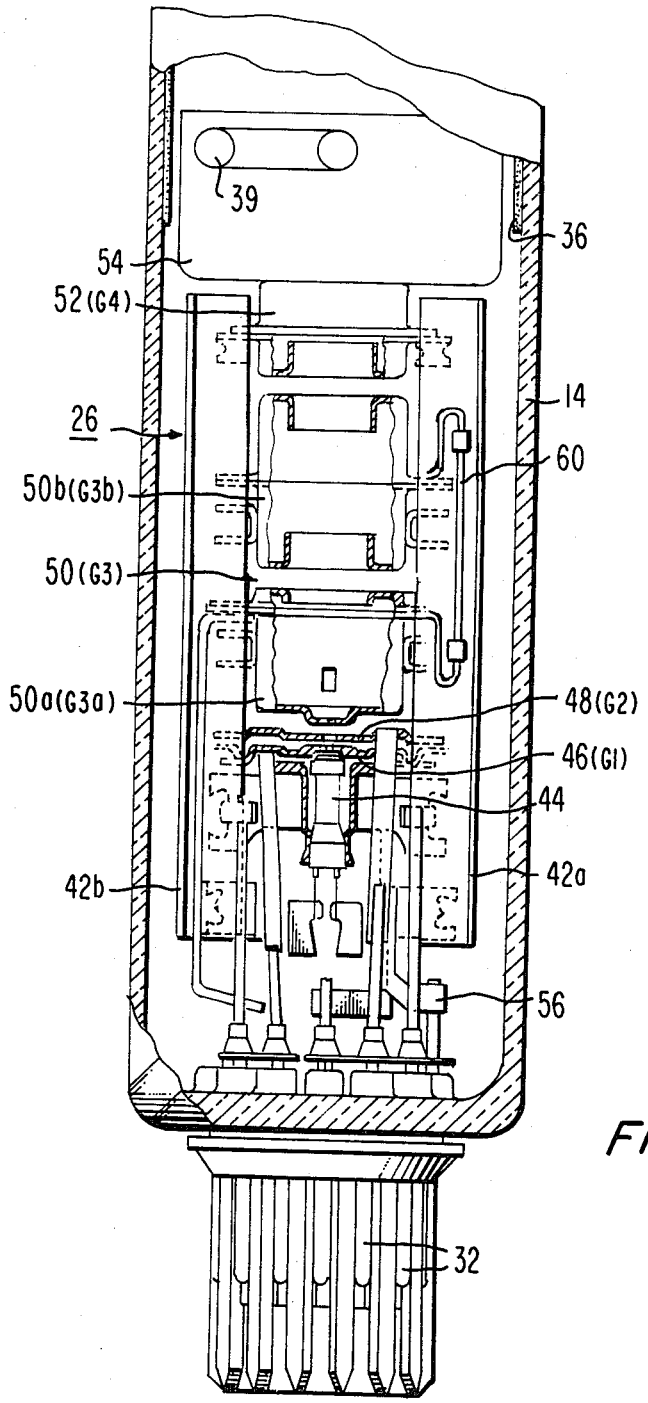
FIG. 2 is a side elevational view of a novel electron gun according to the present invention.

An opaque, conductive coating 36 comprising graphite, iron oxide and a silicate binder is provided on the inner surface of the funnel 16. The coating 36 has a resistance of about 100 ohms and is electrically connected to the high voltage terminal or anode button 38 in the funnel 16. As shown in FIG. 2, the coating 36 extends into the neck 14 and is contacted by three bulb spacers 39 (only one of which is shown), which are preferably made of spring steel, and which also center and position the extended end of the electron gun 26 with the longitudinal axis of the tube 10.

An outer conductive coating 40, which is maintained at ground potential, is provided on the outside surface of the funnel 16. The inner and outer conductive coatings 36 and 40 constitute a high voltage filter capacitor, $C_f$. The capacitive value of the filter capacitor, $C_f$, is about 1000 picofarads.

The novel in-line bipotential electron gun 26 shown in FIG. 2 comprises two glass support rods or beads **42*a* and 42*b* from which the various electrodes are supported to form a coherent unit in a manner commonly used in the art. These electrodes include three substantially equally transversely-spaced coplanar cathodes 4 (one for producing each beam, although only one is shown), a control-grid electrode 46 (also referred to as G1), a screen-grid electrode 48 (also referred to as G2), a first accelerating and focusing electrode 50 (also referred to as G3), a second accelerating and focusing electrode 52 (also referred to as G4), and a shield cup 54, longitudinally-spaced in that order along the rods 42*a* and 42*b*. Several of the various electrodes of the electron gun 26 are electrically connected to the leads 32 either directly or through metal ribbons 56. The electron gun 26 is held in a predetermined position in the neck 14 on the leads 32 and with the bulb spacers 39 on the shield cup 54 which press on and make contact with the internal coating 36**.

The electron gun 26 has a split G3 member 50, comprising a G3*a* or first cup-shaped proximal electrode section **50*a*** and an adjacent G3*b* or first cup-shaped distal electrode section **50*b*. The open ends of the cup-shaped sections are spaced apart in facing relation and axially separated along a plane substantially perpendicular to the beam paths. The terms proximal and distal refer to positions relative to the cathodes 44, wherein the proximal split electrode member is nearer to the cathodes than the corresponding distal split electrode member. An arc-suppression resistor 60** is interconnected, e.g., by welding or brazing, between the G3*a* and G3*b* electrode members **50*a* and 50*b* of the G3 electrode 50**.

Figure 4:
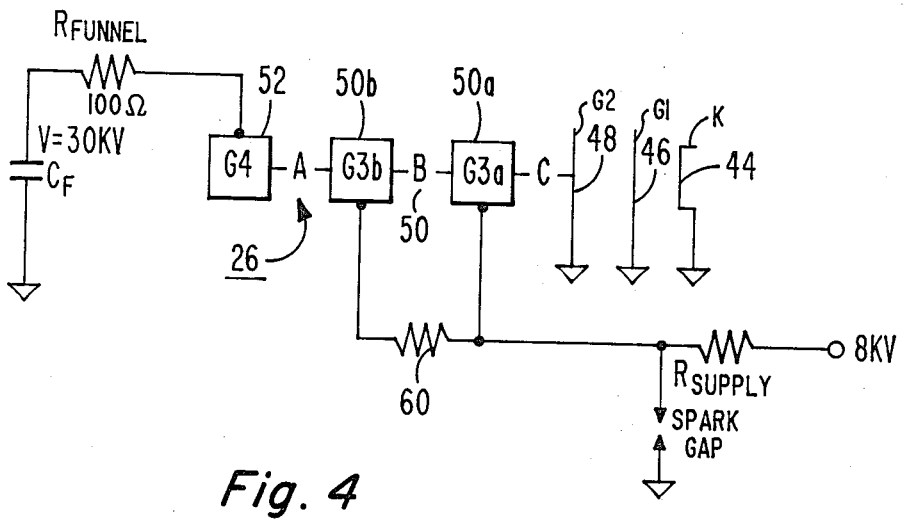
FIG. 4 is a simplified schematic block diagram of the electron gun shown in FIG. 2, including the connections to the operating voltages.

A schematic block diagram of the electron gun 26 is shown in FIG. 4. For simplicity, a single cathode (K) 44 is shown, and the cathode, G1 and G2 electrodes 46 and 48, respectively, are shown as being grounded. The simplified representation of ground potential on the cathode, G1 and G2 electrodes is substantially correct because the actual potentials are low, of the order of hundreds of volts, compared to the 8 kilovolts on the split G3 electrode members **50*a* and 50*b*, and the 30 kilovolts on the G4 electrode 52. The spark gap and internal impedance of the power supply represented by the supply resistor, $R_{supply}$, shown in FIG. 4, are external to the electron gun 26** and form no part of the claimed invention.

The operation of the electron gun 26, schematically shown in FIG. 4, can be described with reference to Table I. The spacing between electrodes is such that it is postulated that an arc or breakdown normally will not occur between the G3*b* distal electrode member **50*b* and the G4 electrode 52 up to at least 20 kilovolts, but breakdown probably will occur at 30 kilovolts. By design, breakdown normally will not occur between the adjacent members 50*a* and 50*b* of the G3 electrode up to at least 30 kilovolts, but breakdown probably will occur at 40 kilovolts. Breakdown normally will not occur between the G2 electrode 48** and the G3*a* proximal electrode member **50*a*** up to at least 15 kilovolts but breakdown probably will occur at 20 kilovolts. Breakdown at lower voltages may sometimes be initiated by irregular electrode surfaces or any of the other causes mentioned heretofore. Table I lists the initial voltages in kilovolts applied to the electrodes as well as the initial voltages across the gaps between electrodes. The gaps are designated by the letters A, B and C. Table I also postulates the resultant voltage distributions on the electrodes and across the gaps for two initial breakdown possibilities and for a multiple arc resulting from one of the initial breakdowns. The first possibility is for an arc across gap A, i.e., between the distal G3*b* electrode member **50*b* and the G4 electrode 52. The second possibility is for an arc across gap C between the G2 electrode 48** and the proximal G3*a* electrode member **50*a***. Finally, the case of a multiple arc across gaps A and C is considered.

TABLE I

| Parameter | G4 (kV) | A (kV) | G3b (kV) | B (kV) | G3a (kV) | C (kV) | G2 (kV) | $R_{eff}$ |
|---|---|---|---|---|---|---|---|---|
| Initial Condition | 30 | 22 | 8 | 0 | 8 | 8 | 0 | ∞ |
| Arc at A | 30 | 0 | 30 | 30 | 0 | 0 | 0 | R |
| Arc at C | 30 | 30 | 0 | 0 | 0 | 0 | 0 | $R_{supply}$ |
| Arcs at A & C | 30 | 0 | 30 | 30 | 0 | 0 | 0 | R |

With reference to Table I and FIG. 4, initially, energizing voltages, represented as ground potential, are applied to the G1 electrode 46 and to the G2 electrode 48. A potential of about 8 kilovolts is applied to both electrode members 50*a* and 50*b* of the G3 electrode which are interconnected by the resistor 60. Ultor potential of about 30 kilovolts is applied through the resistive funnel coating to the G4 electrode 52. During normal operation, the leakage current flowing between the electrodes of the electron gun 26 is typically of the order of 10 microamperes or less and the value of the resistor 60 is selected to provide a minimum potential difference between the split electrode members 50*a* and 50*b*. It has been determined in the Stone copending patent application that a resistor having a value of about $1.5\times10^4$ ohms to about $1.7\times10^7$ ohms may be used; although a value of about $1.5\times10^4$ ohms is preferred. With the initial operating voltages listed in Table I applied to the electron gun 26, the potential difference across gap A is 22 kilovolts, since the G3*b* distal electrode member operates at 8 kilovolts and the G4 electrode operates at 30 kilovolts. The potential difference across gap B is essentially zero since both the proximal and distal electrode members 50*a* and 50*b* of the split G3 electrode 50 are at the same 8 kilovolt potential. The potential difference across gap C is 8 kilovolts since the G2 electrode 48 operates at essentially ground potential while 8 kilovolts is provided to the G3*a* proximal electrode member 50*a*. During normal operation of the electron gun 26, the effective resistance, $R_{eff}$, of the gun is substantially infinite.

In the event an arc occurs across gap A, the resistor 60 functions to limit the arc current to a safe level. As shown in Table I, because of the arc across gap A, 30 kV is present not only on the G4 electrode 52, but also on the G3*b* electrode 50*b*. The resistor 60 limits the voltage impressed on the G3*a* electrode 50*a* to less than 30 kilovolts, but the spark gap breaks down if the voltage on the G3*a* electrode 50*a* rises above 8 kilovolts. Thus, an arc across gap A causes a breakdown of the spark gap and the current through the arc-suppression resistor 60 flows to ground. The effective resistance of the electron gun 26 when an arc occurs across gap A is equal to the value of the resistor 60 which is selected to be $1.5\times10^4$ ohms. Since the voltage across resistor 60 is 30 kilovolts, the arc current is limited to about 2 amperes. Such an arc current will not damage either the electrodes of the associated circuitry.

In the event an arc occurs across gap C, the potential on both the G3*a* and G3*b* electrode members 50*a* and 50*b* will decrease to ground potential. In this event, an unstable condition exists across gap A since the potential on the G3*b* electrode member 50*b* has dropped to ground potential while ultor potential, 30 kilovolts, is present on the G4 electrode 52. Frequently, the plasma created by the initial arc across gap C and the high potential across gap A will result in a multiple arc condition where a breakdown will also occur across gap A. However, before considering the multiple arc condition, it should be noted that with a breakdown across gap C, the effective resistance of the electron gun 26 is now the internal impedance of the power supply, $R_{supply}$. By design, the power supply will limit the arc current produced by an arc between the G2 electrode 48 and the G3*a* electrode member 50*a*.

Because of the unstable condition across gap A resulting from an arc across gap C, a second arc is likely to occur across gap A. This multiple arc condition, i.e., an arc across both gaps A and C, is considered in the last line of Table I. While an arc across gaps A and C creates a potential difference of 30 kilovolts across the gap B between G3*a* and G3*b* electrode members 50*a* and 50*b*, gap B is designed to withstand 30 kilovolts so no further breakdown occurs. The effective resistance for an arc across gaps A and C is equal to the value of resistor 60 and the arc current is limited to a safe level.

Figure 3:
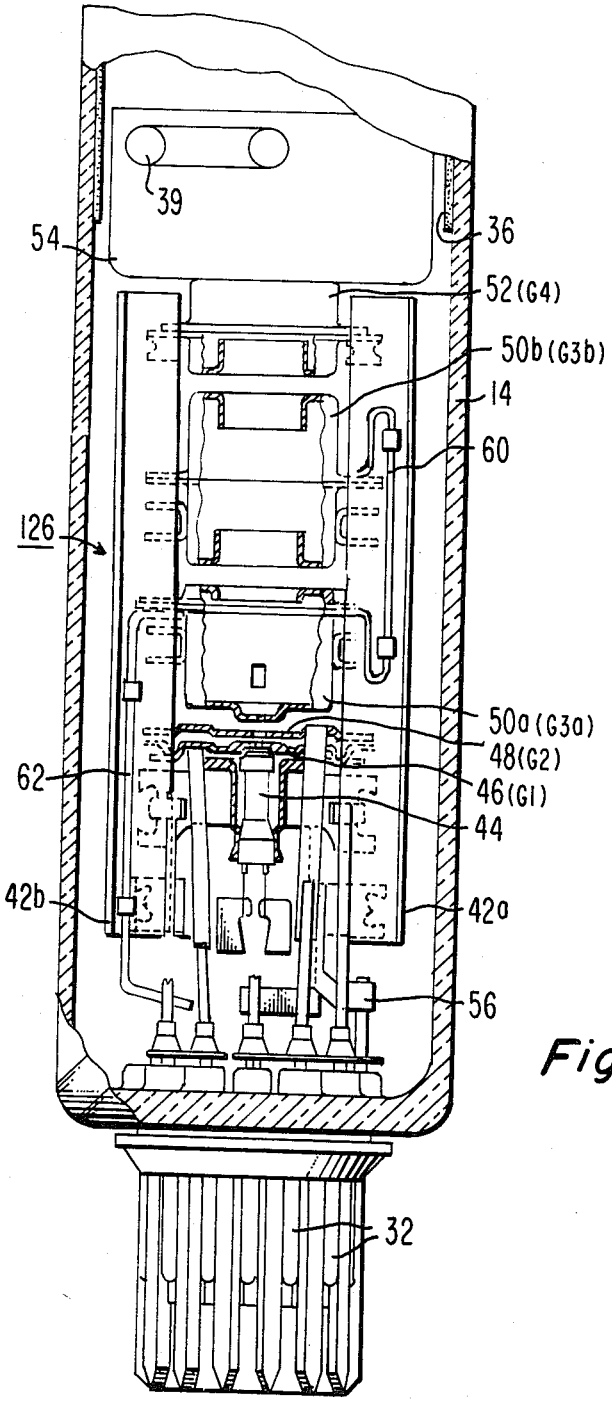
FIG. 3 is a side elevational view of an alternative embodiment of a novel electron gun.
Figure 5:
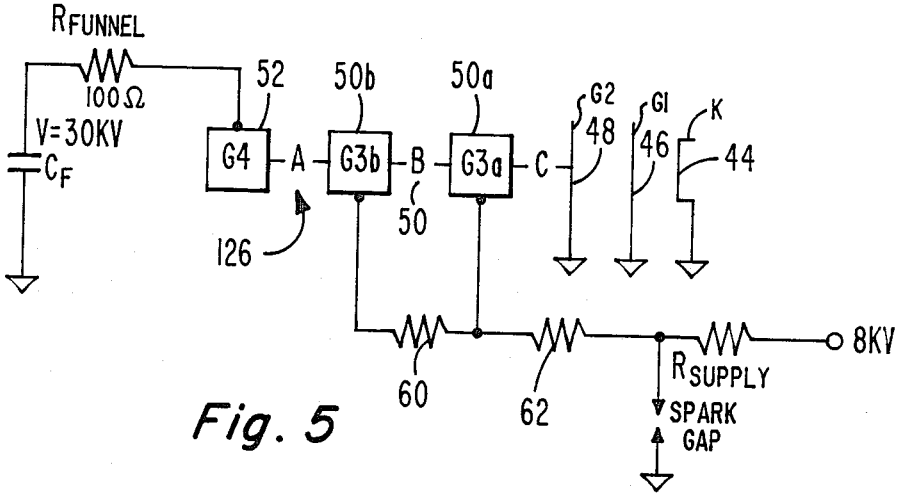
FIG. 5 is a simplified schematic block diagram of the electron gun shown in FIG. 3, including the connections to the operating voltages.

An alternative embodiment to the electron gun 26 is shown in FIGS. 3 and 5 and analyzed in Table II. In this embodiment, an electron gun 126 which is similar to the above-described electron gun 26 has an arc suppression resistor 62 connected between the G3*a* proximal electrode member 50*a* and one of the stem leads 32 in addition to an arc suppression resistor 60 interconnecting the G3*a* and G3*b* electrode members 50*a* and 50*b*. The resistors 60 and 62 may have values ranging from about $1.5\times10^4$ ohms to about $1.7\times10^7$ ohms, however, about $1.5\times10^4$ ohms is preferred. Additionally, the spacing of gap B between the G3*a* and G3*b* electrode members 50*a* and 50*b* has been reduced so that the gap B normally will not break down for a potential difference across the gap up to 20 kilovolts but probably will breakdown for a potential difference across the gap of 30 kilovolts. The reduction in gap B spacing for electron gun 126 may be required, for example, to better shield the electron beams within the electron gun 126 from stray electrostatic and magnetic fields. Gaps A and C remain unchanged in electron gun 126 and are designed to withstand voltages of 20 and 15 kilovolts, respectively, and to breakdown at voltages of about 30 and 20 kilovolts, respectively.

TABLE II

| Parameter | G4 (kV) | A (kV) | G3b (kV) | B (kV) | G3a (kV) | C (kV) | G2 (kV) | $R_{eff}$ |
|---|---|---|---|---|---|---|---|---|
| Initial Condition | 30 | 22 | 8 | 0 | 8 | 8 | 0 | ∞ |
| Arc at A | 30 | 0 | 30 | 15 | 15 | 15 | 0 | 2R |
| Arc at C | 30 | 30 | 0 | 0 | 0 | 0 | 0 | R |
| Arcs at A & C | 30 | 0 | 30 | 30 | 0 | 0 | 0 | R |
| Arcs at A & B | 30 | 0 | 30 | 0 | 30 | 30 | 0 | R |
| Arcs at A, B & C | 0 | 0 | 0 | 0 | 0 | 0 | 0 | $R_{funnel}$ |

The operation of the electron gun 126, schematically shown in FIG. 5, can be described with reference to Table II. Initially, ultor potential of about 30 kilovolts is applied to the G4 electrode 52 and 8 kilovolts is applied to both of the electrode members 50*a* and 50*b* of the G3 electrode 50. The potential applied to the G2 electrode 48 is approximated by ground potential. The resultant potential differences across gaps A, B and C are 22 kilovolts, zero kilovolts and 8 kilovolts, respectively. During normal operation of the electron gun 126, the effective resistance, $R_{eff}$, of the gun is substantially infinite.

In the event an arc occurs across gap A, the resistors 60 and 62 function as a voltage divider and limit the arc current to a safe level. As shown in Table II, because of the arc across gap A, 30 kilovolts is present not only on the G4 electrode 52 but also on the G3*b* electrode 50*b*. The resistor 60 limits the voltage impressed on the G3*a* electrode 50*a* to about 15 kilovolts; however, the spark gap will break down at voltages above 8 kilovolts permitting the arc current to flow to ground, thereby preventing damage to the gun electrodes and/or to the associated circuitry. The effective resistance of the electron gun 126 when an arc occurs across gap A is equal to twice the resistance of the arc-suppression resistor 60 or about $3\times10^4$ ohms. The arc current in the gun 126 is thereby limited to about 1 ampere. Thus, the addition of the second arc-suppression resistor 62 in electron gun 126 decreased the arc current by half for an arc across gap A, and equalizes the voltages across the remaining gaps. In the event that breakdown occurs across gap C, or across gaps A and C, or across gaps A and B, Table II shows that in each case the effective resistance of the electron gun 126 is equal to the resistance of one of the arc-suppression resistors and the arc current is limited to about 2 amperes. In the special, but highly unlikely case, of arcs across gaps A, B and C, i.e., a cascading arc, the effective resistance of the electron gun is equal to the resistance of the funnel coating. As described above, the funnel coating resistance is about 100 ohms so that an arc current of about 300 amperes would occur. Such an arc current will damage the electron gun electrodes and the associated circuitry.

Of the two arc-suppression systems described for electron guns having a split G3 electrode 50, the use of a single arc-suppression resistor 60 as described for electron gun 26 is preferred both for simplicity and cost effectiveness, providing gap B between the adjacent member 50*a* and 50*b* of the G3 electrode 50 can be designed to resist breakdown up to at least 30 kilovolts. If, however, gap B cannot be designed to resist breakdown, then the two resistor arc-suppression system described for electron gun 126 is preferred.

What is claimed is:

1. In an electron gun with at least one cathode for generating an electron beam along a beam path and a plurality of electrodes serially disposed along the beam path, at least one accelerating and focusing electrode having two spaced-apart electrode sections adjacent to one another and axially separated along a plane substantially perpendicular to the beam path, wherein the improvement comprises an arc suppression resistor interconnecting the spaced-apart electrode sections of said electrode, said interconnected electrode sections normally operating at substantially the same voltage, said resistor acting in the event of an arc to limit the arc current.

2. In a cathode ray tube comprising an evacuated envelope with an electron gun therein, said envelope having a neck portion, a faceplate and a funnel portion therebetween, said faceplate having an interior surface with a phosphor screen thereon, said neck portion being closed at the end thereof by a stem having a plurality of stem leads therethrough, said electron gun being mounted on said leads, said electron gun including at least one cathode for generating an electron beam along a beam path towards said screen, a plurality of electrodes serially disposed along the beam path, said electrodes including a control-grid electrode, a screen-grid electrode, a low voltage accelerating and focusing electrode and a high voltage accelerating and focusing electrode, at least one of said accelerating and focusing electrodes having two spaced-apart electrode sections adjacent to one another including a proximal electrode member and a distal electrode member axially separated along a plane substantially perpendicular to the beam path, wherein the improvement comprises a first arc-suppression resistor interconnecting the proximal electrode member and the distal electrode member of said accelerating and focusing electrode, said interconnected electrode members normally operating at substantially the same voltage, said resistor acting in the event of an arc to limit the arc current.

3. The cathode ray tube as described in claim 2, wherein said low voltage accelerating and focusing electrode comprises two spaced-apart electrode sections including the proximal electrode member and the distal electrode member.

4. The cathode ray tube as described in claim 3, wherein a second arc-suppression resistor is connected between the proximal electrode member of said low voltage accelerating and focusing electrode and one of said stem leads, forming a voltage divider with said first arc-suppression resistor.

* * * * *

UNITED STATES PATENT AND TRADEMARK OFFICE

CERTIFICATE OF CORRECTION

PATENT NO. : 4,514,661

DATED : April 30, 1985

INVENTOR(S) : ROBERT PORTER STONE

It is certified that error appears in the above-identified patent and that said Letters Patent is hereby corrected as shown below:

Column 1, Line 18 - "damge" should be -- damage -- ; and

Column 3, Line 63 - "cathodes 4" should be -- cathodes 44 -- .

Signed and Sealed this

*Twenty-sixth* Day of *November 1985*

[SEAL]

*Attest:*

DONALD J. QUIGG

*Attesting Officer*

*Commissioner of Patents and Trademarks*